US005921862A

United States Patent [19]

Ucciardi

[11] Patent Number: 5,921,862

[45] Date of Patent: Jul. 13, 1999

[54] AIR FLOW REVERSAL PREVENTION DOOR ASSEMBLY

[75] Inventor: Frank J. Ucciardi, Pittsburgh, Pa.

[73] Assignee: Consol, Inc., Pittsburgh, Pa.

[21] Appl. No.: 09/016,063

[22] Filed: Jan. 30, 1998

[51] Int. Cl.[6] ..... F24F 13/08

[52] U.S. Cl. ..... 454/353; 137/527.6; 137/527.8

[58] Field of Search ..... 454/227, 353; 137/527.6, 527.8

[56] References Cited

U.S. PATENT DOCUMENTS

| | | | |
|---|---|---|---|
| 364,074 | 5/1887 | Williams . | |
| 2,159,498 | 5/1939 | Birkholz . | |
| 2,225,349 | 12/1940 | Morse . | |
| 2,571,374 | 10/1951 | Mawr . | |
| 2,579,395 | 12/1951 | Pfautsch . | |
| 2,580,797 | 1/1952 | Koch . | |
| 2,700,331 | 1/1955 | Miller . | |
| 2,739,521 | 3/1956 | Spear . | |
| 2,774,116 | 12/1956 | Wolverton . | |
| 3,334,569 | 8/1967 | Lambie . | |
| 3,336,030 | 8/1967 | Lambie et al. . | |
| 3,479,947 | 11/1969 | Myers . | |
| 4,094,336 | 6/1978 | Urschel et al. . | |
| 4,660,599 | 4/1987 | Fast | 137/527.6 X |
| 4,723,533 | 2/1988 | Cover . | |
| 4,738,190 | 4/1988 | Sheu . | |
| 4,942,898 | 7/1990 | Osowski | 137/527.8 X |
| 5,158,486 | 10/1992 | Tamame . | |
| 5,217,406 | 6/1993 | Toth et al. . | |

*Primary Examiner*—Harold Joyce
*Attorney, Agent, or Firm*—Paul A. Beck & Associates

[57] ABSTRACT

An air flow reversal prevention door is mounted to a discharge opening of a ventilation fan. The door includes a frame member with a void in it to permit air flow to pass through the frame and is attached fixedly to a shaft which supports the door and is located between the door and a discharge opening of the ventilation fan. While the door is held open by air from the ventilation fan, the frame member is moved from the edge of the discharge opening toward the door and back and this enables the shaft to rotate because it is fixedly attached to the frame member and it causes the shaft to rotate with movement of the frame member. This causes the shaft to rotate through the entire range of motion of the door between its open position and its collapsed position. This tests the operation of the door without turning off the fan. Whenever the fan fails or is turned off the air flow ceases and the door collapses by gravity toward the discharge opening to prevent air reversal flow.

10 Claims, 6 Drawing Sheets

AIR FLOW REVERSAL PREVENTION DOOR ASSEMBLY

FIELD OF THE INVENTION

This invention relates to an air flow reversal prevention door assembly which is mounted to a discharge opening of a ventilation fan. The assembly permits testing of movement of the door and operation of a seal with the door while the ventilation fan is in operation.

The assembly is useful where doors are employed with fan exhaust systems at underground mines. The fan exhaust forces air from the fan exhaust and holds a door, which is pivoted at the top of the fan exhaust, open. When the fan exhaust ceases to operate and forced air is terminated, the door will collapse or close by gravity and prevent air from flowing in the reverse direction into the fan exhaust. It is required by mining regulations and it is desirable to test whether the door will close whenever the forced air is terminated from the fan exhaust. One way to do this is to terminate the air flow and observe the door collapsing against the frame of the fan exhaust in a vertical position. In some instances even a brief termination of the fan exhaust may be undesirable. For example, this could be true if there are multiple fans in the mine ventilation system because if one fan is stopped it may affect one or more of the other fans. Therefore it would be desirable to test the operation of ability of the door to close without turning off the fan and terminating the exhaust air.

The present invention provides a structure for testing the operation of the door which is used to prevent air reversal upon termination of operation of a ventilation fan without the necessity of terminating the air flow or turning off the fan. This is done by placing another member, such as a frame member, adjacent to the discharge opening of the fan exhaust which acts as a peripheral seal when the door closes upon cessation of air flow. The frame member has a void to permit air flow to normally pass through the frame. The frame member is placed between the air flow reversal prevention door and the discharge opening. Movement of the frame member will cause relative movement between the door and a shaft supporting the door. The frame member is supported from the same shaft which supports the door. The frame member is keyed to the shaft. This causes the shaft to rotate when the frame member is moved about the axis of the shaft.

BACKGROUND OF THE INVENTION

There are various needs for a door which prevents reversal of air flow direction when an exhaust fan fails. Usually these types of doors are pivoted about an upper portion of a frame of an exhaust fan support system at the exhaust area and the rushing air pushes the door open and escapes. Whenever the exhaust fan stops, the air flow ceases and the door, under the force of gravity, closes against the exhaust duct of the exhaust fan and provides a seal, with some minimal leakage, which prevents air from rushing in the reverse direction into the exhaust fan area.

Exhaust fans are used for ventilation of underground mines. Each of the ventilation fans ventilate and exhaust air from the underground mine by pulling a draft of air through the exhaust fan and out to the atmosphere at the surface. If an exhaust fan fails, it is important that air does not flow from the atmosphere back into the mine through the ventilation fan. To prevent that, an air flow reversal prevention door is mounted at the exhaust of a ventilation or exhaust fan. The door is held open by the force of air when the fan is operating and when the fan stops the air flow ceases and the door collapses by gravitational pull against the ventilation fan exhaust and remains in a vertical position where it seals (with some minimal leakage) and prevents air from reversing its direction from the atmosphere to enter the exhaust system. Compliance with mining regulations requires that air reversal doors on all ventilation fans for underground mines must be tested frequently, usually every thirty days, to determine that they close properly. It is possible that a fan door, once it is held open by the force of the air exhausting from the ventilation fan, could be held open by some malfunction of the structure which supports 10 the fan door to enable it to pivot about a top portion of the ventilation fan structure which would prevent the fan door from dropping into its vertical position to seal against air flow entering the ventilation fan area after the ventilation fan ceases to function.

To test the functioning of the air flow reversal prevention door requires that the ventilation fan be shut off to insure that the door collapses. While the test is being performed, no one is permitted underground and all personnel must be evacuated from the mine. Shutting off the fan adversely affects the fan motor and in time will cause motor failure. Also, shutting down one fan in a multiple fan mine may cause problems to one of the other fans in the mine. If the fan is not restarted within 15 minutes of shut off time, power to the mine must be interrupted.

The purpose for determining that air flow reversal doors close properly when a fan fails is to ensure the safety of the people in the mine at the time at the time of failure. If the air flow reversal prevention door fails to close properly when the fan fails or is shut off, vacuum pressure caused by the other mine fans which are still operating will cause methane contaminated air to be pulled out of the return area of the mine into the active portions of the mine where a methane buildup or explosion can occur.

There is no known method which provides a means for testing the proper function of the reversal prevention door while the ventilation fan is in operation. The present invention solves the problem by providing a structure with the air flow reversal prevention door which permits testing of the movement of the door and operation of a seal with the door while the ventilation fan is in operation.

SUMMARY OF THE INVENTION

The present invention provides an air flow reversal prevention door mounted to a discharge opening of a ventilation fan that permits testing of movement of the door and operation of a seal with the door while the ventilation fan is in operation. The assembly has a first means which includes a shaft and a pair of shaft bearing assemblies supporting the shaft which permits rotation of the shaft within the bearing assemblies and a pair of door bearing assemblies on the shaft. The shaft is freely rotatable about the door bearings in the door bearing assemblies which are attached to the door and support the door. The first means is located at the top of the discharge opening and pivotally supports the door in a vertical position adjacent to the discharge opening and enables the door to pivot away from the discharge opening as an air flow from the fan pushes on the door. A frame member adjacent to the discharge opening which acts as a seal when the door is closed upon cessation of air flow is provided. The frame member has a void to permit air from the ventilation fan to pass through the frame. A second means supports the frame member in a vertical position between the discharge opening and the door and is coupled to the first means and enables the frame member to pivot with the first means and cause movement of the first means when the frame member is moved relative to the door. The second means includes a clamp, which is attached to the frame member and is fixedly attached or keyed to the shaft. When the frame member is moved it rotates the shaft within the shaft bearing assemblies while the door remains open from the air flow. The size of the frame member is greater than the opening of the discharge opening but less than the size of the door in its outer dimensions. The frame has a counterbalance weight member attached above the shaft to enable ease of moving the frame about the shaft.

To test the operation of an air flow reversal prevention door mounted to a discharge opening of a ventilation fan described above the structure as described above is provided and the frame member is moved relative to the door while the door is held open by the air flow. By doing this the movement of the first means, which is the shaft mounted within the shaft bearing assemblies, and the movement of the shaft relative to those bearing assemblies and to the door bearing assemblies is observed. If the movement is free then no obstruction is found causing interruption of the rotation of the shaft relative to the door. The frame member is moved relative to the door from the vertical position all the way to the door while the door is held open by the air flow. This will provide the full range of movement of the shaft which supports the door and enables the door to pivot. This full range of movement will indicate that the door, when it is moved from its open position all the way to the vertical position or the closed position against the fan discharge is fully operable. When the frame is moved from the vertical position to the open position against the door while the door is held open by the air flow the abutment of the frame against the door will determine and verify that there is a seal between the door and the frame which can be observed. The frame member is moved toward the door while the door is held open by the air flow and then the frame member is moved back to the discharge opening from the door while the door is held open by the air flow thereby insuring full rotational movement in both directions of the bearings and shaft which support the door.

A BRIEF DESCRIPTION OF THE DRAWINGS

FIG. 1 A full end view in elevation of the door and the frame member;

FIG. 2 a view in elevation of the door only, without the frame, also showing the counter weight and the shaft;

FIG. 3 a view of the frame only, in elevation, showing the counter weight and the shaft;

FIG. 4 a transverse sectional view of FIG. 1 along line IV—IV showing the door and the frame in a vertical and closed position;

FIG. 5 a transverse sectional view of the door and the frame of FIG. 1 along line IV—IV in an alternative position in which the door is held open by the exhausting air from the ventilation fan; and FIG. 6 a transverse sectional view of the door and the frame of FIG. 1 along line IV—IV in an alternative position in which the door is held open by the exhaust air and the frame is moved partially toward the door.

DETAILED DESCRIPTION OF A PREFERRED EMBODIMENT

Figure 1:
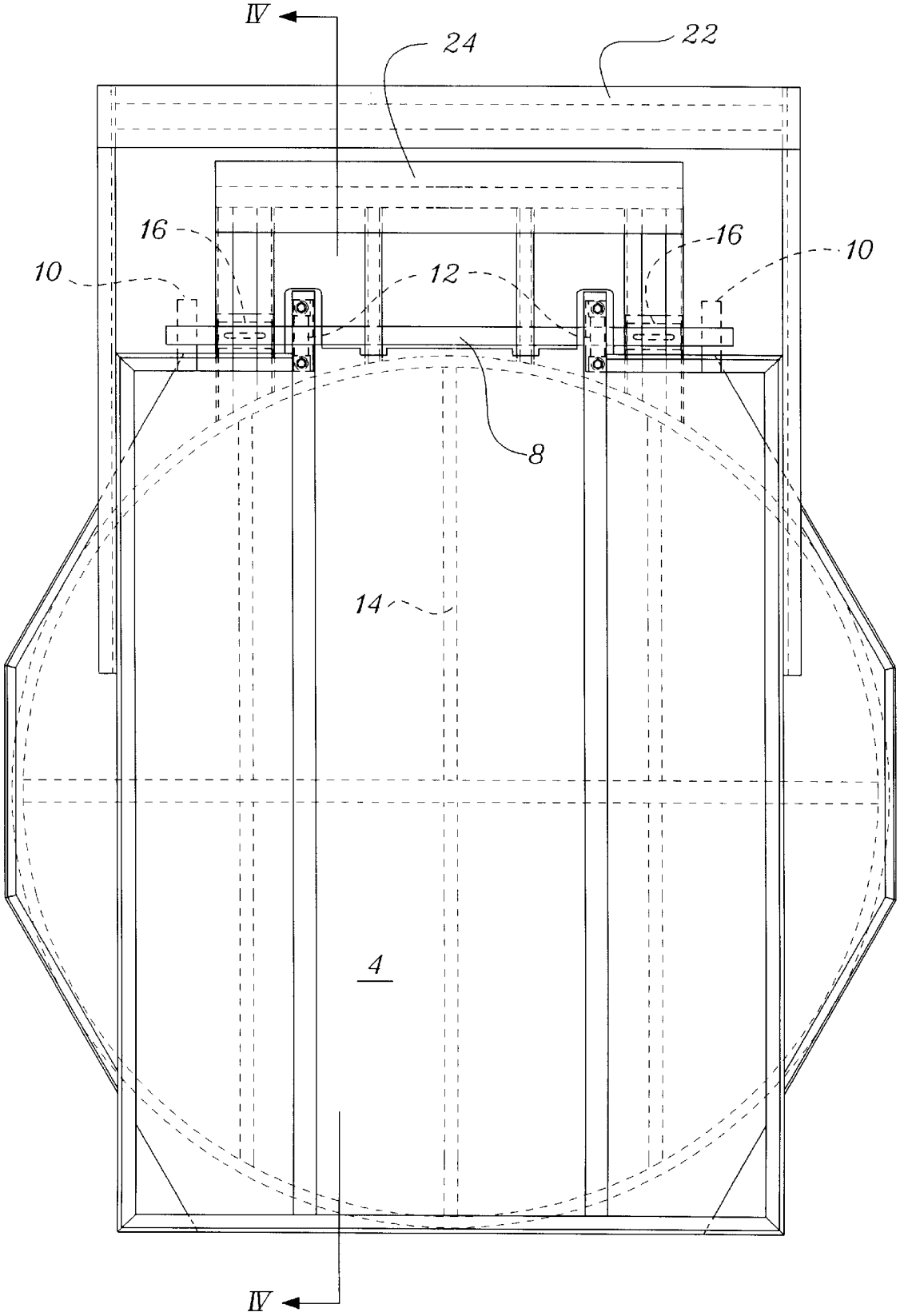
Figure 2:
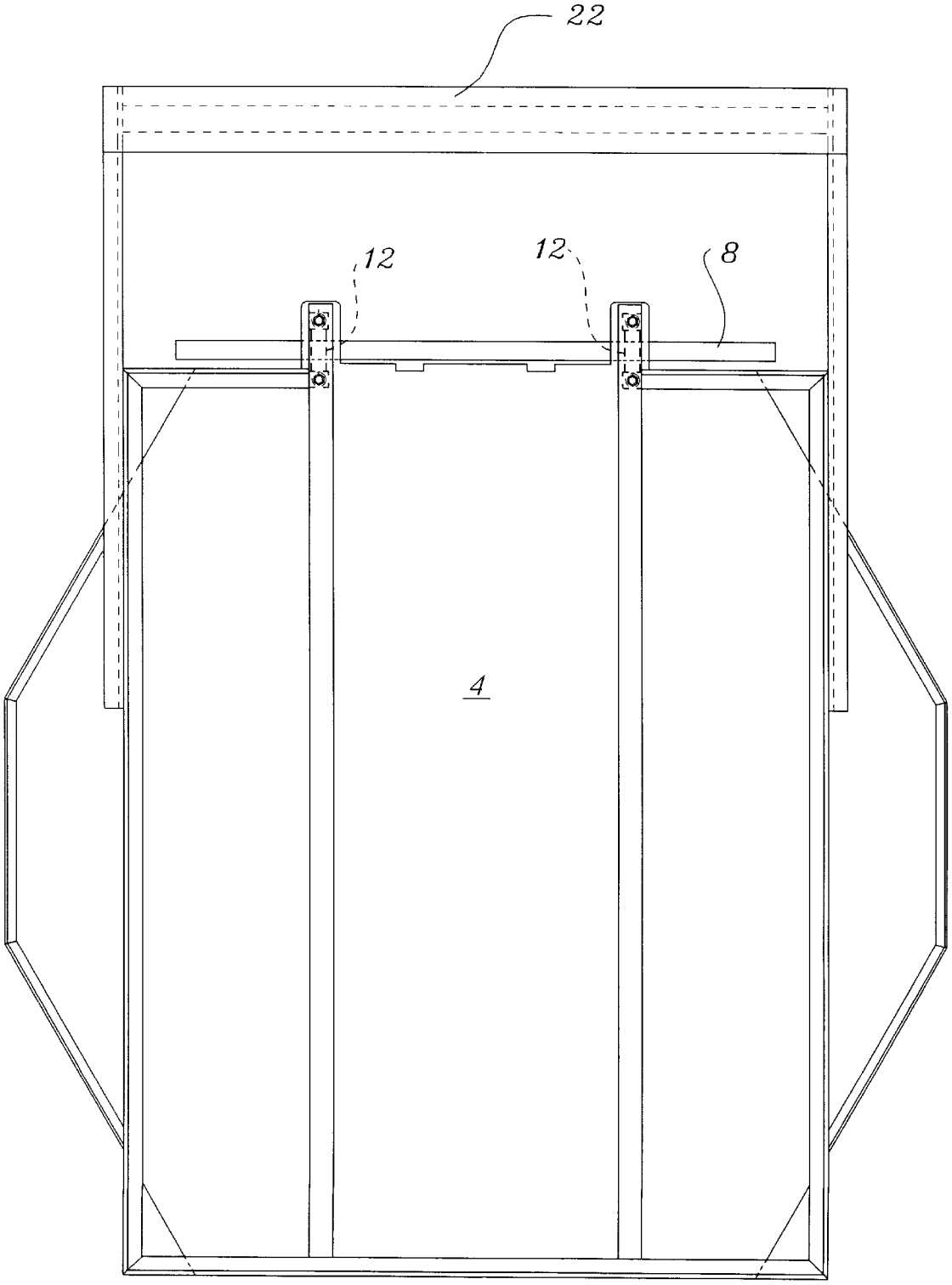
Figure 3:
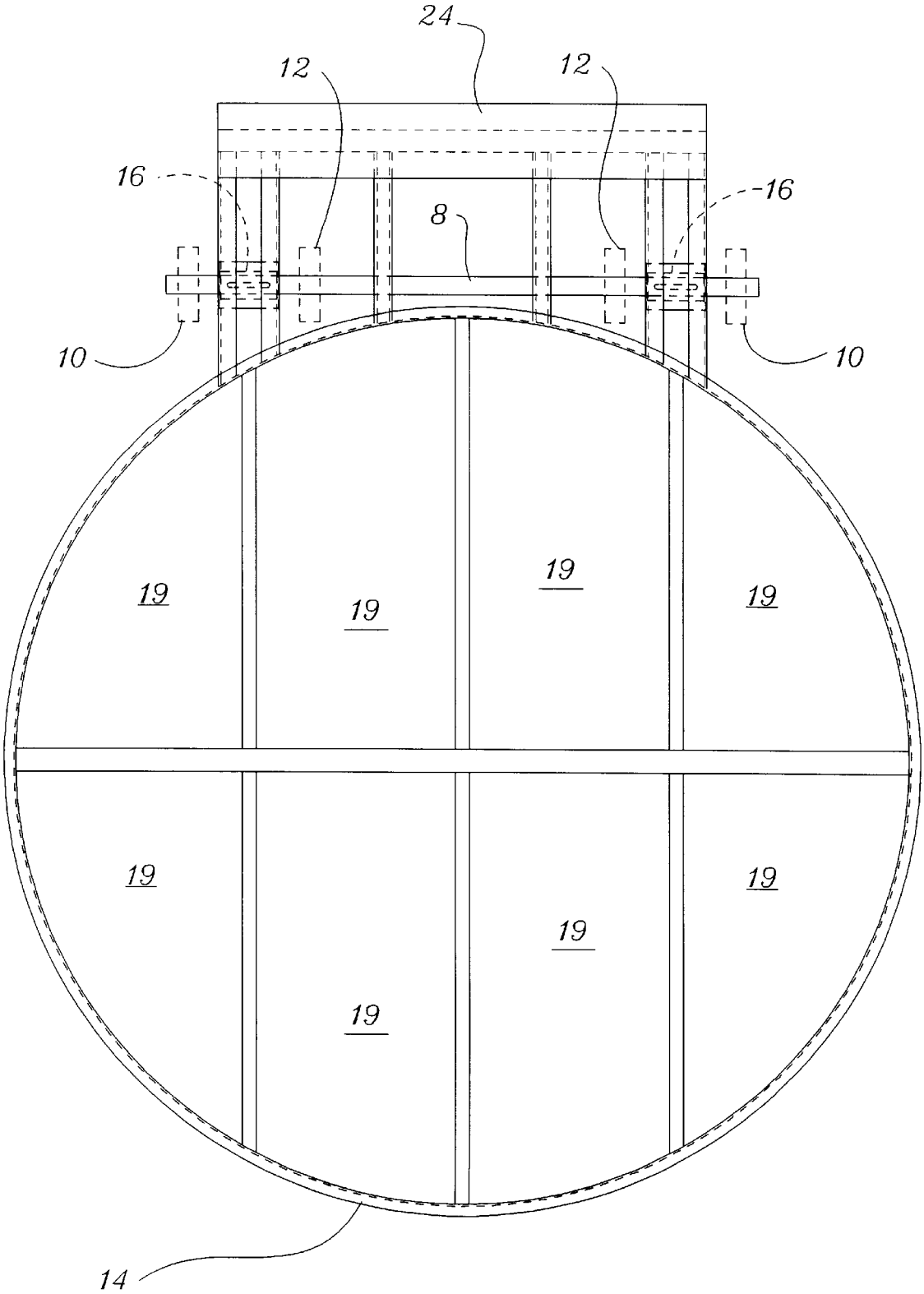
Figure 4:
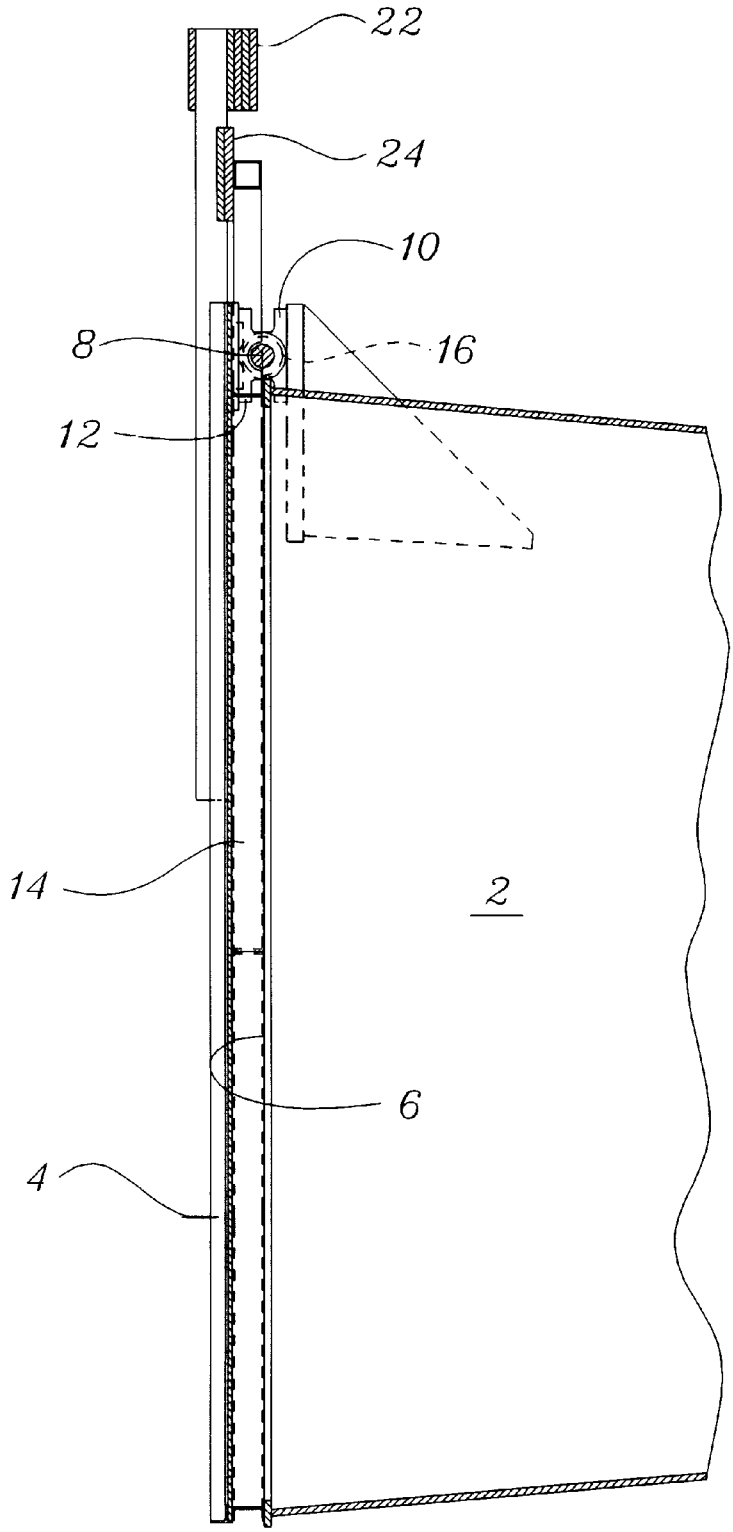
Figure 5:
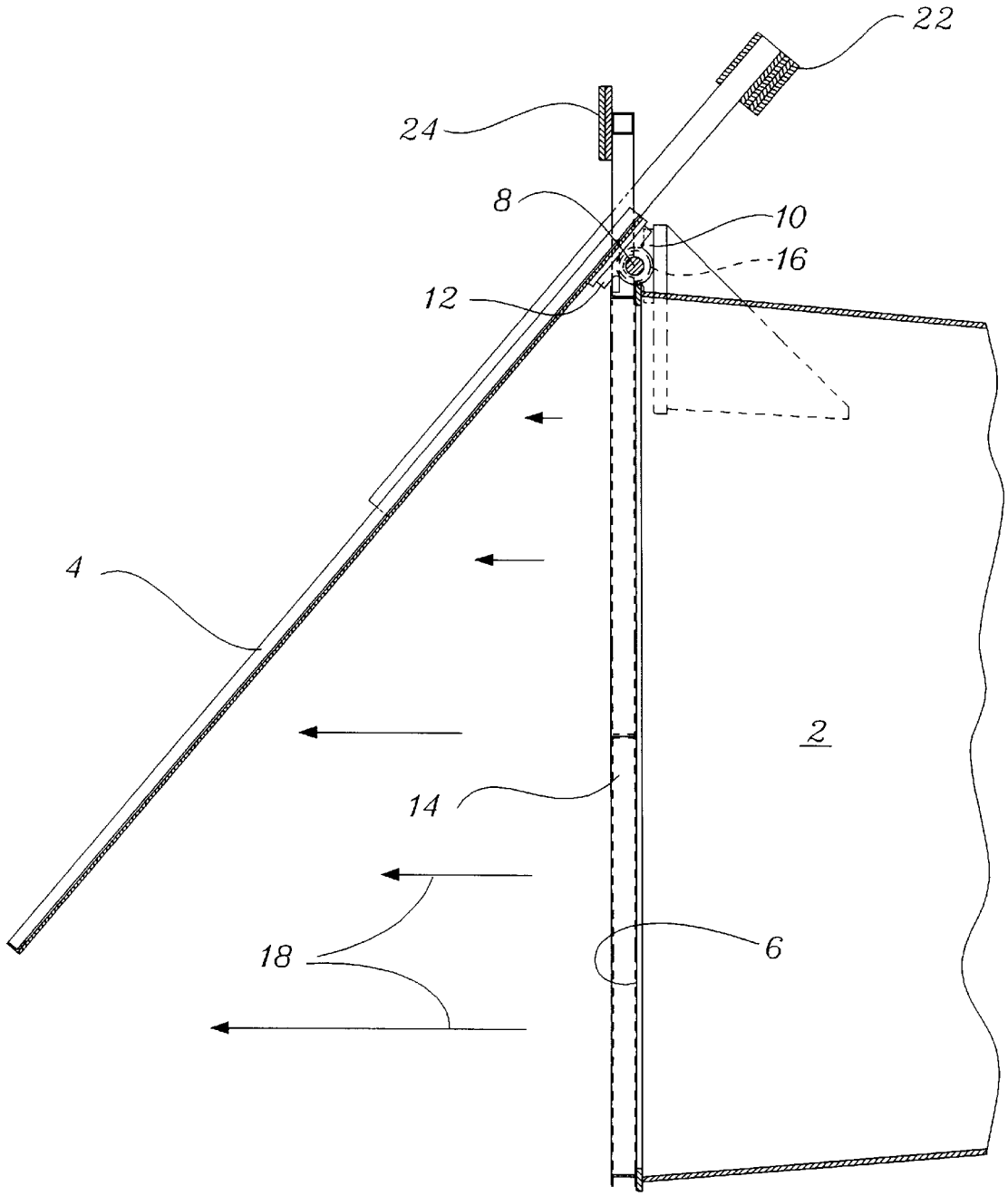
Figure 6:
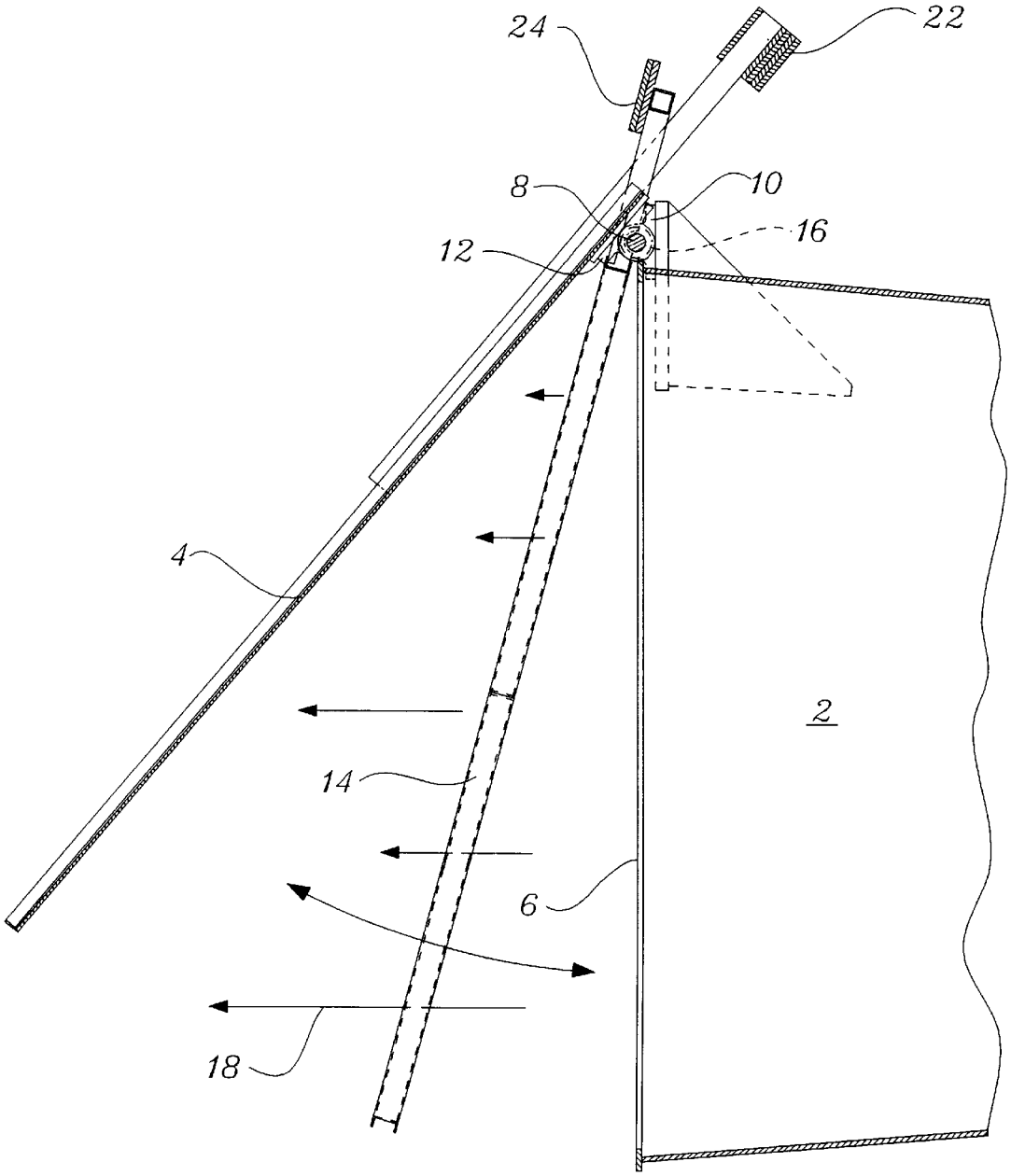

FIGS. 4, 5, and 6 show a discharge opening of a ventilation fan. The ventilation fan is not shown but the duct work at the exhaust portion from the ventilation fan is shown and will be treated as the ventilation fan structure 2. This is considered the exhaust duct work of the ventilation fan. An air flow reversal prevention door 4 is mounted to a discharge opening 6 of the ventilation fan 2. A first means at the top of the discharge opening 6 of the ventilation fan 2 pivotally supports the door 4 in a vertical position adjacent to the discharge opening 6 and enables the door 4 to pivot away from the discharge opening 6 as an air flow 18 from the fan 2 pushes on the door 4 as shown in FIGS. 5 and 6. The first means which supports the door 4 includes a shaft 8 and a pair of shaft bearing assemblies 10 which support the shaft 8 and permits rotation of the shaft 8 within the bearing assemblies 10. The first means also includes a pair of door bearing assemblies 12 mounted on the shaft 8. The shaft 8 is freely rotatable within the door bearing assembly 12. The door bearing assemblies 12 are attached to the door 4 and support the door 4.

A frame member 14 which acts as a seal when the door 4 is closed adjacent to the discharge opening 6 upon cessation of air flow 18 has a void 19 to permit the air flow 18 to pass through the frame 14. A second means supports the frame 14 in a vertical position between the discharge opening 6 and the door 4 and is coupled to the shaft 8 which is part of the first means and enables the frame 14 to pivot with the shaft 8 and cause movement of the shaft 8 when the frame member 14 is moved relative to the door 4. The second means includes a clamp member 16 which can also be a pillow block with a key keying the shaft 8 in which the pillow block is mounted or fixed to the frame member 14. The frame member 14 is fixedly (such as by key way) attached to the shaft 8 so that when the frame member 14 moves it rotates the shaft 8 within the shaft bearing assemblies 10 while the door 4 remains open from the air flow 18. This is shown in FIG. 6 in which the frame member 14 is moved away from the discharge opening 6 and toward the door 4 or is moved relative to the door 4. The shaft 8 will rotate with frame member 14 as shown in FIG. 6 while at the same time the door 4 remains in its position held open by the force of the air 18 shown by the arrows 18 forcing against the door 4 to keep it open and away from the discharge opening 6.

The frame member 14 is of outside dimensions or size which is greater than the opening of the discharge 6 but less than the size or outside dimensions of the door 4. This enables a seal to be achieved whenever the door 4 is collapsed in the vertical position against the frame member 14 as shown in FIG. 4 and a seal is achieved. There will be some minimal leakage in the seal.

The door 4 has a counter balance 22 and the frame member 14 has a counter balance 24. The counter balance 24 for the frame 14 is attached above the shaft 8 to enable easy movement of the frame 14 about the shaft 8.

To test the operation of the door 4 to determine that it will move toward the discharge opening 6 upon the failure of the ventilation fan 2, the frame 14 as shown in FIG. 5 is moved from the vertical position toward the door 4 which is held open by the air currents 18. The full movement of the frame 14 from its position shown in FIG. 5 toward the door 4 and adjacent to the door 4 shown in FIG. 6 in its open position will cause the shaft 8 to move within the door bearing assemblies 12 and therefore determine that the shaft 8 is freely rotatable with respect to the door 4 which is supported by the bearing assemblies 12. The shaft 8 rotates with respect to the door bearing assemblies 12 wherein the door 4 is held stationary in an open position by the air currents 18 as shown in FIGS. 5 and 6. When the frame 14 is pushed toward the door 4 which is maintained open as shown in FIGS. 5 and 6 the sealing of the frame 14 with respect to the door 4 can be visually inspected. When all the structural parts and the test for the rotation of the shaft 8 is completed the frame 14 is moved back from the abutting position against the door 4 toward its resting position shown in FIG. 5 against the discharge opening 6.

When the above steps are done two things have been determined. One knows that the door 4 is capable of moving relative to the shaft 8 because the door rotates if the ventilation fan 2 stops and the air 18 ceases, the door 4 will move by the force of gravity toward the discharge opening 6 and the bearing assembly 12 which supports the door 4 will move relative to the shaft 8 which is fixed. This is accomplished by movement of the frame 14 from the discharge opening 6 toward the door 4 causing relative motion of the shaft 8 to which the frame 14 is fixedly keyed through the clamp member 16 or keyed at 16 through the clamp member and/or pillow block.

This has enabled a full test of the function of the door 4 movement and the sealing of the door 4 with respect to the discharge 6 without turning the ventilation fan 2 off and requiring the personnel in the mine to evacuate the mine for the test. There are substantial savings in man hours and wear and tear on the fan. Also, the possibility of affecting the operation of other fans in a multiple fan mine is eliminated.

As various changes could be made in the above construction and method without departing from the scope of the invention, it is intended that all matter contained in the above description as shown in the accompanying drawings shall be interpreted as illustrative and not as a limitation.

I claim:

1. An air flow reversal prevention door mounted to a discharge opening of a ventilation fan that permits testing of movement of the door and operation of a seal with the door while the ventilation fan is in operation the improvement comprising:

a. a first means at a top of the discharge opening pivotally supporting the door in a vertical position adjacent to the discharge opening and enabling the door to pivot away from the discharge opening as an air flow from the fan pushes on the door;

b. a frame member which acts as the seal when the door is closed adjacent to the discharge opening upon cessation of air flow and having a void to permit the air flow to pass through the frame; and c. a second means supporting the frame member in a vertical position between the discharge opening and the door and fixedly attached to the first means causing the first means to rotate with the frame member and cause movement of the first means when the frame member is moved relative to the door.

2. The air flow reversal prevention door as recited in claim 1 in which the first means includes:

a. a shaft;

b. a pair of shaft bearing assemblies supporting the shaft and permitting rotation of the shaft within the bearing assemblies; and c. a pair of door bearing assemblies mounted on the shaft, the shaft is freely rotatable within the door bearing assemblies and the door bearing assemblies are attached to the door and support the door.

3. The air flow reversal prevention door as recited in claim 2 in which the second means includes a clamp which is attached to the frame member and is fixedly attached to the shaft, when the frame member is moved it rotates the shaft within the shaft bearing assemblies while the door remains open from the air flow.

4. The air flow reversal prevention door as recited in claim 3 in which the size of the frame member is greater than the opening of the discharge opening but less than the size of the door.

5. The air flow reversal prevention door as recited in claim 4 in which the frame has a counter balance weight member attached above the shaft to enable ease of moving the frame about the shaft.

6. Method for testing the operation of an air flow reversal prevention door mounted to a discharge opening of a ventilation fan that permits testing of movement of the door and operation of a seal with the door while the ventilation fan is in operation comprising:

a. providing a first means at the top of a discharge opening for supporting the door in a vertical position adjacent the discharge opening, the door being held open by an air flow from the fan;

b. providing a frame member which acts as the seal when the door is closed upon cessation of air flow and having a void to permit the air flow to pass through the frame;

c. providing a second means supporting the frame member which is positioned between the discharge opening and the door and coupled to the first means and enabling the frame member to pivot with the first means and cause movement of the first means when the frame member is moved relative to the door; and d. moving the frame member relative to the door while the door is held open by the air flow whereby the movement of the first means is observed.

7. The method as recited in claim 6 in which the first means includes:

a. a shaft;

b. a pair of shaft bearing assemblies supporting the shaft and permitting rotation of the shaft within the bearing assemblies; and c. a pair of door bearing assemblies mounted on the shaft, the shaft is freely rotatable within the door bearing assemblies and the door bearing assemblies are attached to the door and support the door.

8. The method as recited in claim 7 in which the second means includes:

a clamp which is attached to the frame member and is fixedly attached to the shaft, when the frame member is moved it rotates the shaft within the shaft bearing assemblies while the door remains open from the air flow.

9. The method as recited in claim 8 including moving the frame member toward the door while the door is held opened by the air flow.

10. The method as recited in claim 8 including moving the frame member toward the discharge opening while the door is held opened by the air flow.

* * * * *